US010549320B2

(12) United States Patent
Shu et al.

(10) Patent No.: US 10,549,320 B2
(45) Date of Patent: Feb. 4, 2020

(54) STAIN REMOVAL DEVICE

(71) Applicants: HAIER ASIA CO., LTD., Tokyo (JP); QINGDAO HAIER WASHING MACHINE CO., LTD., Qingdao, Shandong (CN)

(72) Inventors: Hai Shu, Qingdao (CN); Peishi Lv, Qingdao (CN); Masahiro Fujiwara, Tokyo (JP); Masakazu Yamamoto, Tokyo (JP); Masaru Noro, Tokyo (JP); Zhengtao Wang, Qingdao (CN)

(73) Assignees: HAIER ASIA CO., LTD., Tokyo (JP); QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 79 days.

(21) Appl. No.: 15/557,271

(22) PCT Filed: Jul. 7, 2016

(86) PCT No.: PCT/CN2016/089068
§ 371 (c)(1),
(2) Date: Sep. 11, 2017

(87) PCT Pub. No.: WO2017/008674
PCT Pub. Date: Jan. 19, 2017

(65) Prior Publication Data

US 2018/0272383 A1 Sep. 27, 2018

(30) Foreign Application Priority Data

Jul. 10, 2015 (JP) ..... 2015-138539

(51) Int. Cl.
*B08B 1/00* (2006.01)
*D06F 43/00* (2006.01)
(Continued)

(52) U.S. Cl.
CPC ..... *B08B 1/00* (2013.01); *D06F 43/002* (2013.01); *A47L 25/00* (2013.01); *D06F 3/04* (2013.01); *D06F 7/04* (2013.01)

(58) Field of Classification Search
CPC . A47L 25/00; A47L 25/08; D06F 3/04; D06F 7/04; D06F 43/002
See application file for complete search history.

(56) References Cited

U.S. PATENT DOCUMENTS 3,089,790 A 5/1963 Lewis et al.
2002/0189635 A1 12/2002 Bodet et al.
(Continued)

FOREIGN PATENT DOCUMENTS

CN 104088112 10/2014
EP 2811062 12/2014
(Continued)

OTHER PUBLICATIONS

Extended European Search Report dated Oct. 25, 2018 in EP App. No. 16823821.0, National Phase of PCT/CN2016/089068.
(Continued)

*Primary Examiner* — Spencer E Bell
(74) *Attorney, Agent, or Firm* — Greenberg Traurig, LLP

(57) ABSTRACT

A stain removal device, a head portion having a beating surface; a vibration unit which is located on an extension line of an axis of the head portion orthogonal to the beating surface and vibrates the head portion in an axis direction through driving of a solenoid actuator; and a liquid supply unit which has a liquid accommodating portion capable of accommodating liquid and supplies the liquid in the liquid accommodating portion to the beating surface through vibration of the head portion generated by the vibration unit.

8 Claims, 8 Drawing Sheets

(51) Int. Cl.

| | |
|---|---|
| ***D06F 7/04*** | (2006.01) |
| *D06F 3/04* | (2006.01) |
| *A47L 25/00* | (2006.01) |

(56) References Cited

U.S. PATENT DOCUMENTS

| | | | | |
|---|---|---|---|---|
| 2014/0352365 | A1 | 12/2014 | Seo et al. | |
| 2014/0352366 | A1 | 12/2014 | Seo et al. | |
| 2015/0292139 | A1* | 10/2015 | Lee | D06F 19/00 68/214 |

FOREIGN PATENT DOCUMENTS

| | | |
|---|---|---|
| GB | 769191 | 2/1957 |
| JP | H11169578 | 6/1999 |
| JP | H11323723 | 11/1999 |
| JP | 2001000785 | 1/2001 |
| JP | 2001310165 | 11/2001 |
| JP | 2002035485 | 2/2002 |

OTHER PUBLICATIONS

International Application No. PCT/CN2016/089068, International Search Report, dated Oct. 13, 2016.

* cited by examiner

STAIN REMOVAL DEVICE

The present application is a national phase application under 35 U.S.C. § 371 of International Patent Application PCT/CN2016/089068, filed on Jul. 7, 2016, entitled "STAIN REMOVAL DEVICE", which claims priority to Japanese Patent Application No. 2015-138539, filed Jul. 10, 2015, the entire disclosures of which applications are incorporated herein by reference.

TECHNICAL FIELD

The present disclosure relates to a small-sized stain removal device capable of performing partial beating and washing on a cloth product, automatically supplying liquid to a stain portion appearing on the cloth product and imparting a beating force.

BACKGROUND

In the case that dirt is partially attached to the cloth product to form stains, compared with the overall washing of the cloth product, it is generally intented to only wash the stain portion from aspects of a decontamination effect and operation efficiency. As a device capable of partially washing the cloth product, a stain removing system of non-patent literature 1 can be exemplified.

The stain removing system of the non-patent literature 1 is composed of a bottle body for accommodating a detergent, and an absorbing sheet. A pore for supplying the detergent is formed in the top of the bottle body. The stain removing system can beat the stain portion with the top of the bottle body in such a state that the absorbing sheet is abutted against the bottom. The detergent is supplied to the stain portion by using the beating action. The supplied detergent is penetrated into the cloth product, and is absorbed into the absorbing sheet together with the dirt constituting the stain portion.

However, such a stain removing system of the non-patent literature 1 requires a hand holding the bottle body to move up and down rapidly, so a problem of hand fatigue is present.

On the other hand, a patent literature 1 discloses a stain removal device which can spray a solvent to the stain portion of clothes by pressing a switch and can remove the dirt from the stain portion of the clothes together with the solvent through attraction generated by a negative pressure of a fan. Since the solvent can be automatically coated to the clothes and the coated solvent can be automatically attracted (removed) by the stain removal device, the beating force does not need to be repeatedly applied to the stain portion manually, and the hand fatigue resulted from rapid movement of the hand does not happen.

However, since the structure disclosed in the patent literature 1 does not apply a physical force to the stain portion, time may be spent to remove the stains or the stains may not be removed completely, for example, when solid dirt hard to be mixed with the solvent is attached to the stain portion. Namely, the structure disclosed in the patent literature 1 does not have sufficient stain removing capability. In order to exert high stain removing capability, a structure capable of physically crushing the solid dirt by applying the beating force to the stain portion as disclosed in the non-patent literature 1 may be used. In addition, the structure disclosed in the patent literature 1 has a mechanism for spraying the solvent, the fan and the like, so the number of components is increased; and the device is easy to become large and is difficult to be produced into a portable structure.

CURRENT TECHNICAL LITERATURE

Patent Literature

Patent Literature 1: Japanese Laid-Open Patent Publication No. 2003-996

Non-Patent Literature

Non-patent Literature 1: Internet <URL:http//www.lion-.co.jp/ja/seihin/brand/025/06.htm>

SUMMARY

Problems to be Solved by the Disclosure

The purpose of the present disclosure is to effectively solve such problems and supply a stain removal device. The stain removal device can automatically impart a beating force to a stain portion, play a high stain removing effect, and realize miniaturization.

Solutions for Solving the Problems

In view of the above problems, the present disclosure proposes the following solutions.

Namely, the stain removal device of the present disclosure includes: a head portion having a beating surface; a vibration unit which is located on an extension line of an axis of the head portion orthogonal to the beating surface and vibrates the head portion in an axis direction through driving of a solenoid actuator; a liquid accommodating portion capable of accommodating liquid; and a liquid supply unit which supplies the liquid in the liquid accommodating portion to the beating surface through vibration of the head portion generated by the vibration unit.

In addition, the stain removal device of the present disclosure may include: a main body housing, wherein the head portion protrudes from a front end portion of the main body housing; and a plurality of cover portions which are detachably arranged at the front end portion of the main body housing and have different lengths in the axis direction within a range of an operating stroke of the solenoid actuator. The stain removal device of the present disclosure is used in such a state that any of the plurality of cover portions is mounted at the front end portion of the main body housing.

Alternatively, the present disclosure may adopt the following structure: the stain removal device includes: a main body housing, wherein the head portion protrudes from a front end portion of the main body housing; and a cover portion detachably arranged at the front end portion of the main body housing, wherein changing portions are formed on the main body housing and the cover portion; and the changing portions can change a length of the cover portion protruding from the front end portion of the main body housing within a range of an operating stroke of the solenoid actuator.

In addition, the present disclosure may adopt the following structure: a convex portion extending to the axis direction as the changing portion is formed at any of the front end portion of the main body housing and a basal end portion of the cover portion; a first concave portion having a depth for substantially clamping the entire convex portion and a second concave portion shallower than the first concave portion are formed at the other of the front end portion of the main body housing and the basal end portion of the cover portion as the changing portion; and when the convex portion is clamped with the first concave portion and the second concave portion, a protruding length of the cover portion can be changed.

In the structure, an elastically deformable claw portion may be formed at one of the front end portion of the main body housing and the basal end portion of the cover portion; and a buckling portion buckled with the claw portion is formed at a position, at which the convex portion is clamped with the concave portion, of the other of the front end portion of the main body housing and the basal end portion of the cover portion.

In addition, the present disclosure may adopt the following structure: a screw portion as the changing portion is formed on an outer circumferential surface of any of the main body housing and the cover portion; and a nut portion, as the changing portion, corresponding to the screw portion is formed on an inner circumferential surface of the other of the main body housing and the cover portion; where the protruding length of the cover portion can be changed by increasing or decreasing a screw-in quantity of the screw portion screwed into the nut portion.

Particularly, the present disclosure may adopt the following structure: the solenoid actuator imparts an attraction force away from a direction of the head portion to a movable iron core; and the vibration unit has a link mechanism which protrudes the head portion in a direction opposite to a displacement direction of the movable iron core.

Effects of the Disclosure

According to the present disclosure described above, since the vibration unit can vibrate the head portion by the driving of the solenoid actuator and supply the liquid in the liquid accommodating portion to the beating surface of the head portion from the liquid supply unit, an action that the head portion beats a stain removing object is mechanized (automatized), and the high stain removing effect can be played without moving hands rapidly. In addition, since the driving force in a straight-line direction of the solenoid actuator can be directly applied to the vibration of the head portion, it is unnecessary to install a gear and other speed reduction conversion mechanisms for converting a rotating force of a motor into a force in the straight-line direction, for example, as a case that the motor is used as a driving source; and therefore, the number of components can be reduced to realize compactness (miniaturization).

In addition, according to the present disclosure which is used in the state that any of the plurality of cover portions having different lengths in the axis direction is mounted at the front end portion of the main body housing, a distance from the front end portion of the main body housing to the stain removing object can be changed according to the mounted cover portion, thereby mechanically changing the operating stroke of the solenoid actuator and adjusting the strength of the beating force applied by the head portion to the stain removing object.

Alternatively, according to the present disclosure in which the changing portion capable of changing the length of the cover portion protruding from the front end portion of the main body housing is formed, the distance from the front end portion of the main body housing to the stain removing object can be changed according to the protruding length of the cover portion, thereby mechanically changing the operating stroke of the solenoid actuator and adjusting the strength of the beating force applied by the head portion to the stain removing object.

Specifically, according to the present disclosure in which the protruding length of the cover portion can be changed in the case that the convex portion is clamped with the first concave portion and the second concave portion, the entire convex portion is substantially clamped in the relatively deep concave portion, only the front end portion of the convex portion is clamped in the relatively shallow concave portion, and the protruding length of the cover portion is just increased to such an extent, thereby easily adjusting the strength of the beating force by the cover portion.

Further, according to the present disclosure in which the buckling portion buckled with the claw portion is formed at a position where the convex portion is embedded in the concave portion, the cover portion is fixed to the main body housing in the axis direction by the claw portion and a clamping portion, thereby preventing the cover portion from dropping off the main body housing during stain removing operation.

In addition, according to the present disclosure in which the protruding length of the cover portion can be changed by increasing or decreasing the screw-in quantity of the screw portion screwed into the nut portion, the protruding length of the cover portion can be changed continuously, thereby easily adjusting the length of the beating force by the cover portion.

Specifically, according to the present disclosure in which the vibration unit has the link mechanism capable of protruding the head portion to the direction opposite to the displacement direction of the movable iron core, when the solenoid actuator exerts a strongest force, i.e., when the movable iron core of the solenoid actuator is lifted to a highest level, the head portion can be protruded by the link mechanism, thereby increasing the beating force.

Figure 1:
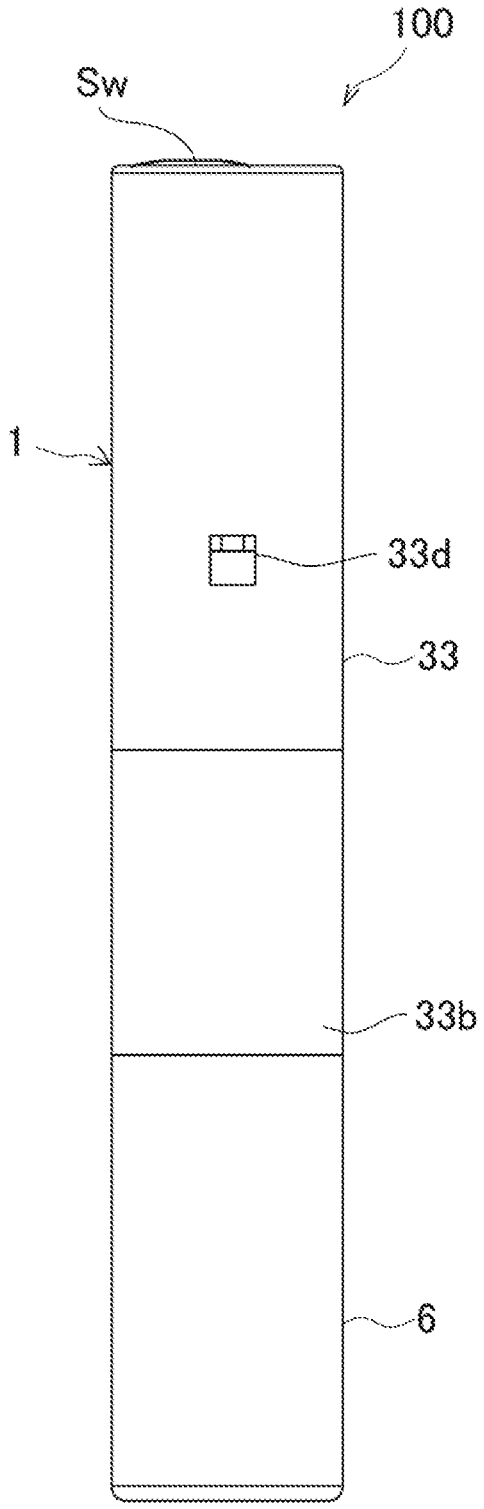
FIG. 1 is a diagram illustrating an appearance of a stain removal device of an embodiment of the present disclosure.

A list of reference numerals:

4: Vibration unit; 5, 5*x* and 5*y*: Protective cover (cover portion); 5*a*: Basal end portion of protective cover; 5*a*1: First concave portion; 5*a*2: Second concave portion; 5*c*: Buckling portion; 11: Head portion; 12: Liquid accommodating portion; 20: Liquid supply unit; 21*a*: Beating surface; 33 and 33': Main body housing; 33*b* and 33*c*: Front end portion of main body housing; 33*c*1: Convex portion; 33*c*2: Claw portion; 40: Link mechanism; 41: Solenoid actuator;

41*a*: Movable iron core; 100: Stain removal device; A: Changing portion; S: Axis of head portion.

DETAILED DESCRIPTION

Hereinafter, an embodiment of the present disclosure will be described with reference to drawings.

Figure 2:
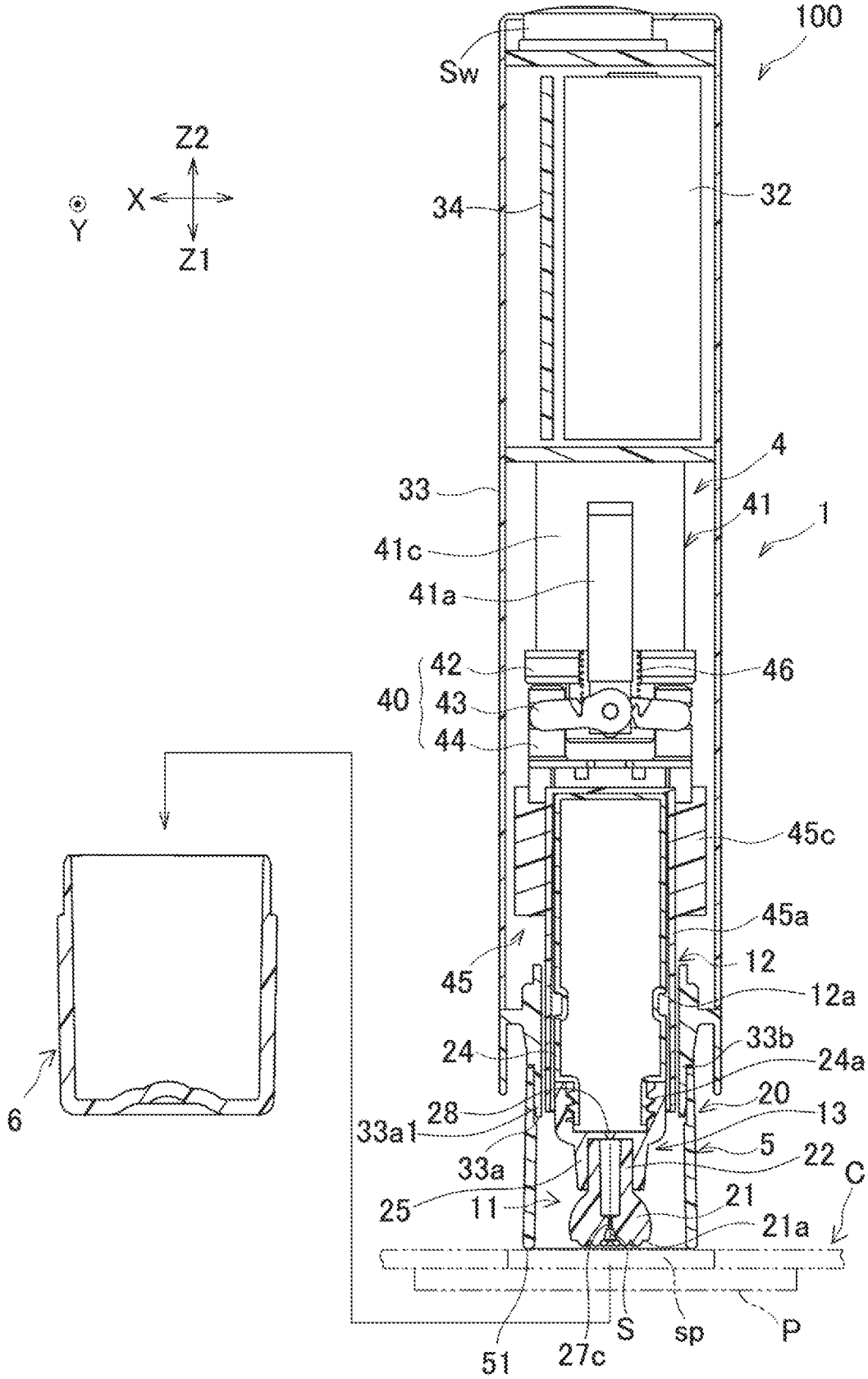
FIG. 2 is a longitudinal section view illustrating a same stain removal device in such a state that a cover member is removed.
Figure 3:
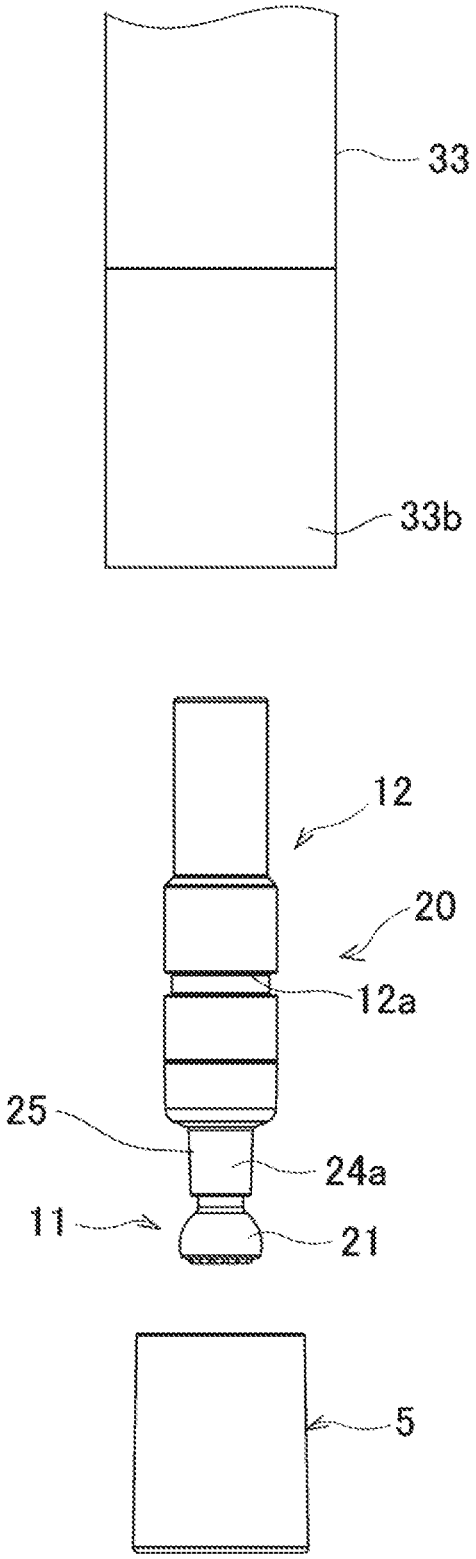
FIG. 3 is a front view illustrating a liquid accommodating portion and a protective cover portion in a state of being removed from a main body housing constituting a same stain removal device.

FIG. 1 is a front view illustrating an appearance of a stain removal device 100 according to an embodiment of the present disclosure. FIG. 2 is a longitudinal section view illustrating the stain removal device 100 of the present embodiment. FIG. 3 is a front view illustrating a liquid accommodating portion 12 and a protective cover portion 5 in a state of being removed from a man body housing 33 constituting the same stain removal device of the present embodiment.

As shown in FIG. 2, the stain removal device 100 has a device body 1, a cover member 6 and a protective cover (guide device) 5.

The device body 1 includes a head portion 11, a liquid supply unit 20, a vibration unit 4, a battery 32, and a bottomed cylindrical main body housing 33 in which these components are assembled.

The head portion 11 has a beating portion 21 and a head inserting portion 22. The beating portion 21 is a component which has a beating surface 21*a* and has a substantially semicircular longitudinal section, and more specifically, a component slightly more similar to a circle than a semicircle. Such a head portion 11 is located at a center of an end surface of the main body housing 33.

The head inserting portion 22 is a component which is extended from the beating portion 21 and is detachably inserted into an inserted portion 25 described later. A side surface of the head inserting portion 22 has a plurality of annular protruding portions not shown in figures and separately formed in the vibration direction. When the head inserting portion 22 is inserted to the inserted portion 25, an inner surface of the inserted portion 25 is pressed by the protruding portions, so as to stably fix the head portion 11 to the inserted portion 25 without changing a fixation degree even if assembly and disassembly are performed repeatedly.

It should be noted that, although the head portion 11 is made of resin (for example, nylon) in the present embodiment, the material is not limited to the resin and can also be metal (for example, Stainless Used Steel: sus) and the like.

The liquid supply unit 20 as shown in FIG. 2 and FIG. 3 includes the liquid accommodating portion (a water bottle) 12 and a water supply path 13.

The liquid accommodating portion 12 includes a liquid storing portion 24 and the inserted portion 25. The liquid storing portion 24 is a transparent or semitransparent hollow component capable of accommodating the liquid. A cover member 24*a* is mounted at the front end portion of the head portion 11 side in a screw-fixing manner. The liquid can be accommodated in the liquid accommodating portion 12 by removing the cover member 24*a*. In addition, the liquid storing portion 24 is formed so that a portion in the axis direction has a small radial direction, and a clamping concave portion 12*a* capable of being clamped with a clamping claw 45*b* (referring to FIG. 4 and the like) described later is arranged. A cylindrical water supply hole 28 conically opened toward the head portion 11 is formed in such a liquid storing portion 24. The liquid in the liquid storing portion 24 flows down through the water supply path 13 from the cylindrical water supply hole 28 and then is supplied to the beating surface 21*a*.

The inserted portion 25 is extended from the liquid storing portion 24. The head inserting portion 22 of the head portion 11 is detachably inserted into the inserted portion 25 by pressing lightly. It should be noted that the head inserting portion 22 is not limited to be inserted into the inserted portion 25 in a pressing manner and can also be inserted in a screw-fixing manner.

Water, a detergent mixture obtained by mixing water with detergent at a certain ratio, a common solvent such as ethanol, gasoline, etc., a special detergent for removing stains or the like can be used as the liquid herein. In the present embodiment, only water can be used as the liquid accommodated in the liquid storing portion 24.

As shown in FIG. 2, the water supply path 13 is formed from the liquid storing portion 24 to the beating surface 21*a* through the head portion 11. The liquid in the liquid accommodating portion 12 is provided to the beating surface 21*a* of the head portion 11. A small-diameter portion 27*c* having a flow path cross section smaller than that of other portions is partially formed on the water supply path 13.

The liquid dripped from the liquid storing portion 24 is retained in such a water supply path 13. When the head portion 11 is vibrated, the water supply path 13 discharges a little amount of liquid slowly (for example, 1-1.5 cc/min) to the beating surface 21*a* of the head portion 11 at a stable flow rate. On the other hand, when the head portion 11 is not vibrated, particularly in the small-diameter portion 27*c*, the liquid is prevented from dripping by surface tension.

The vibration unit 4 shown in FIG. 2 is located on an extension line of an axis S of the head portion 11 orthogonal to the beating surface 21*a* and vibrates the head portion 11 protruding more than the front end portion 33*b* of the main body housing 33 to the axis direction by an opening 33*a* through driving of a solenoid actuator (41) using electric power of a battery 32. The battery 32 is a rechargeable battery in the present embodiment and is accommodated in the main body housing 33 via an opening/closing cover not shown in figures and partially formed on the main body housing 33. Hereinafter, the axis direction of the head portion 11 is sometimes referred to as a vibration direction. In addition, in the vibration direction, a direction in which the head portion 11 protrudes outward the device is referred to as a protruding direction Z1, and an opposite direction thereof is referred to as a returning direction Z2. In addition, a vertical direction on paper in FIG. 2 is referred to as a first direction Y. Further, a direction orthogonal to the vibration direction and the first direction Y is referred to as a second direction X.

The solenoid actuator 41 has a movable iron core 41*a*. The movable iron core 41*a* is moved to the vibration direction by being alternately switched to ON or OFF by energizing a coil not shown in figures. An axis of the movable iron core 41*a* is arranged on the extension line of the axis S of the head portion 11. A specific structure of the vibration unit 4 for vibrating the head portion 11 will be described later.

The cover member 6 can be assembled and disassembled from the front end portion 33*b* of the main body housing 33 and is removed from a device body 1 as shown in FIG. 2 when the stain removing operation described later is performed. In addition, the cover member 6 is mounted on the device body 1 when the stain removal device 100 is carried, and can effectively prevent water leakage outside the device, impact on the head portion 11 and the like.

The protective cover 5 as the cover portion is a non-flexible and substantially cylindrical transparent member made of resin, is located at a position surrounding the side surface of the head portion 11, as shown in FIG. 2, and is detachably mounted at the front end portion 33*b* of the main body housing 33. The length (height) of the protective cover 5 is set so that an action end of the head portion 11 in the protruding direction Z1 slightly protrudes beyond a protruding end 51 of the protective cover 5 when the movable iron core 41*a* is moved at a maximum operating stroke.

By providing such a protective cover 5, the protective cover 5 can shield the liquid scattered by the vibration of the head portion 11 during the stain removing operation described later so as to prevent the liquid from diffusing in a wide range. Therefore, an area of a wetted portion of clothes C can be reduced; and the clothes C can be worn immediately after the stain removing operation.

Such a stain removal device 100 may be a handheld-sized device capable of partially washing the clothes C as the stain removing object. When the stain removing operation is performed, an absorption pad P as a pad is abutted below the stain portion sp of the clothes C; and a stain removing detergent is directly coated on the stain portion of the clothes C. Moreover, the stain removal device 100 is used in such a manner that the protruding end 51 of the protective cover 5 is pressed on the clothes C at a position where the beating surface 21*a* of the head portion 11 is opposite to the stain portion sp. It should be noted that the detergent can also be not used at this time.

When a power switch Sw is operated in the state, the solenoid actuator 41 vibrates the head portion 11 by the driving force of the movable iron core 41*a* linearly moved in the axis direction through power supply driving from the battery 32, and imparts the beating force to the stain portion sp by the beating surface 21*a*.

When the device body 1 is moved along the clothes C and such an action is repeated, the liquid (water in the present embodiment) supplied to the stain portion sp is dissolved together with the detergent coated to the stain portion sp to form the dirt of the stain portion sp; and the dirt is beaten out of the clothes C and is absorbed by the absorption pad P. Namely, the stain removal device 100 transfers the dirt of the clothes C as well as the liquid and the detergent to the absorption pad P by applying the beating force so as to remove the stains.

It should be noted that the absorption pad P is not particularly limited, various articles can be used as long as the liquid absorption speed is high, and for example, a product after folding kitchen paper can be used.

The stain removal device 100 described above includes: the head portion 11 having the beating surface 21*a*; a vibration unit 4 which is located on the extension line of the axis S of the head portion 11 orthogonal to the beating surface 21*a* and vibrates the head portion 11 in the axis direction through the driving of the solenoid actuator 41; and a liquid supply unit 20 which has the liquid accommodating portion 12 capable of accommodating liquid and supplies the liquid in the liquid accommodating portion 12 to the beating surface 21*a* through the vibration of the head portion 4 generated by the vibration unit 4.

When such a structure is adopted, since the vibration unit 4 vibrates the head portion 11 by the driving of the solenoid actuator 41 and supplies the liquid in the liquid accommodating portion 12 to the beating surface 21*a* of the head portion 11 from the liquid supply unit 20, the head portion 11 can automatically perform the action of beating the clothes C as the stain removing object, thereby playing high stain removing effect without rapid movement. In addition, since the driving force in a straight-line direction of the solenoid actuator 41 is used for the vibration of the head portion 11, it is unnecessary to install a gear and other speed reduction conversion mechanisms for converting a rotating force of a motor into a force in the straight-line direction, for example, as a case that the motor is used as a driving source. Therefore, the stain removal device 100 can reduce the number of components, simplify the structure, greatly reduce a diameter of the main body housing 33, and realize compactness.

Thus, the stain removal device 100 of the present embodiment has good compactness and portability. When residual food stains, cosmetics and the like are attached to the cloth product outside, the stains may be not apparent by using partial washing. In addition, curtains, carpets and other articles not easy to be washed integrally can be cleaned partially and appropriately. Further, the stain removal device 100 can also be suitable for pre-washing the dirt at the collar, cuffs and other parts of the clothes C at an early stage of washing with a washing machine.

Figure 4:
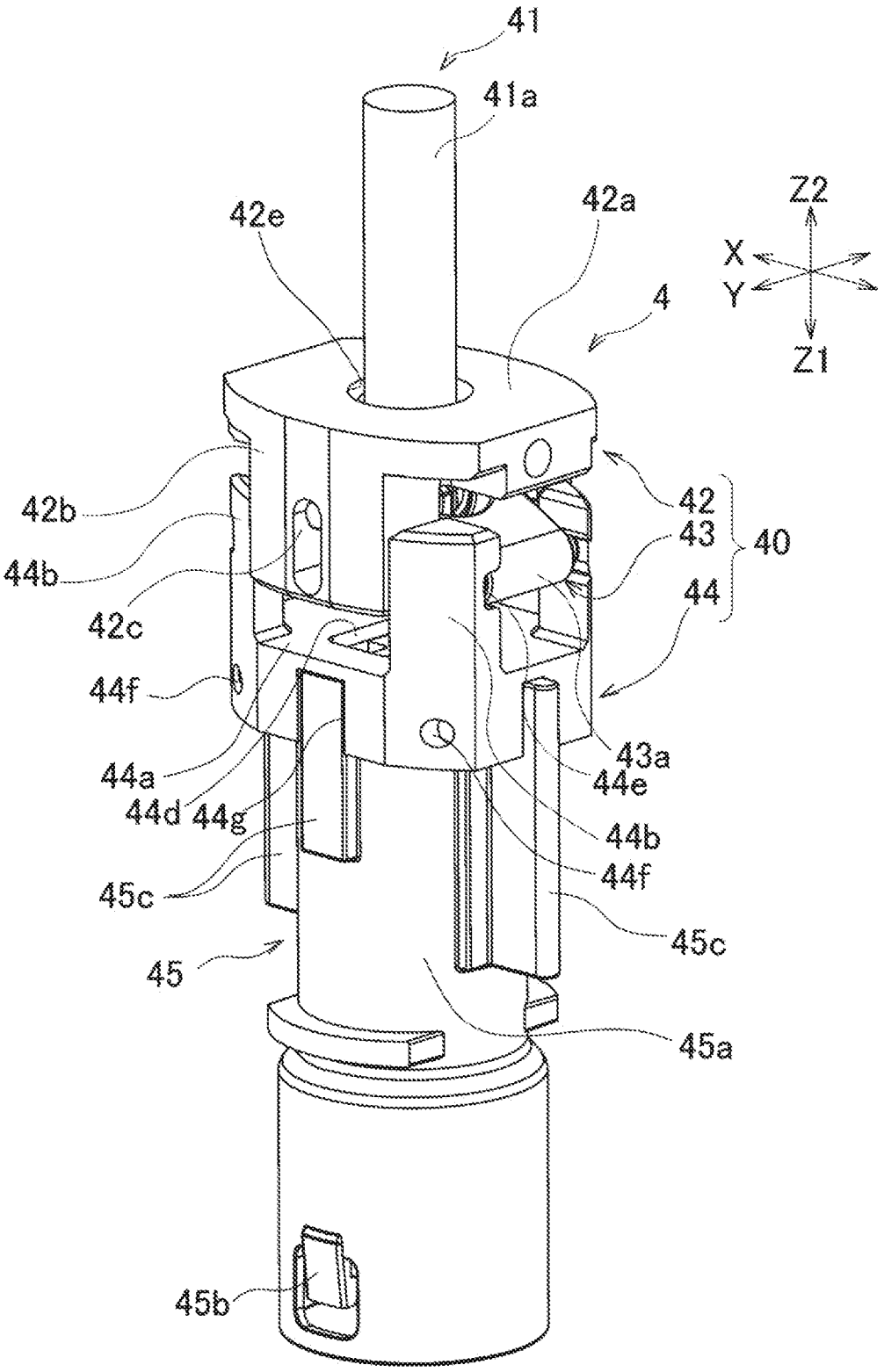
FIG. 4 is a stereogram illustrating a vibration unit constituting a same stain removal device.
Figure 5:
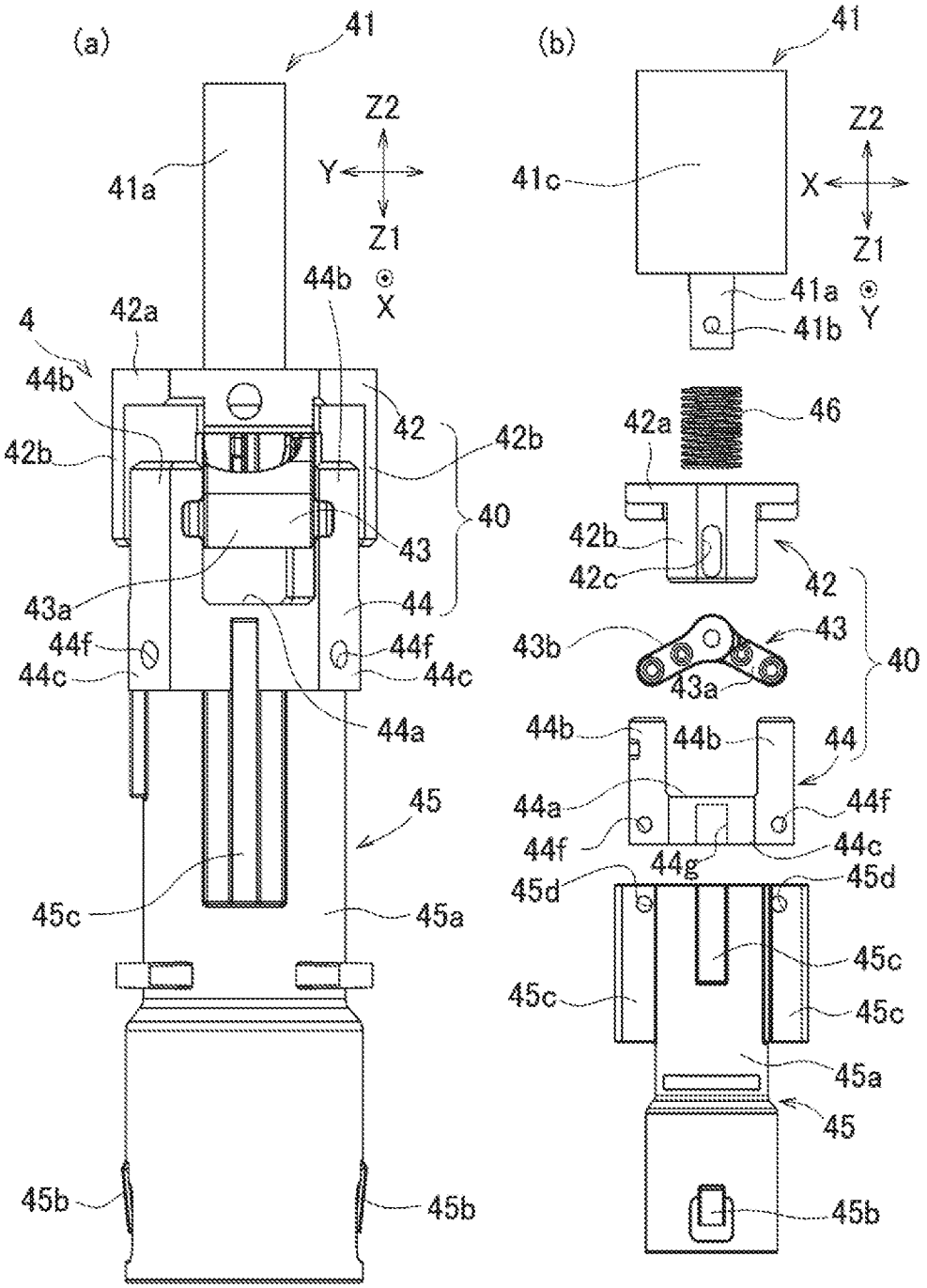
FIG. 5 is a diagram illustrating a vibration unit constituting a same stain removal device.
Figure 6:
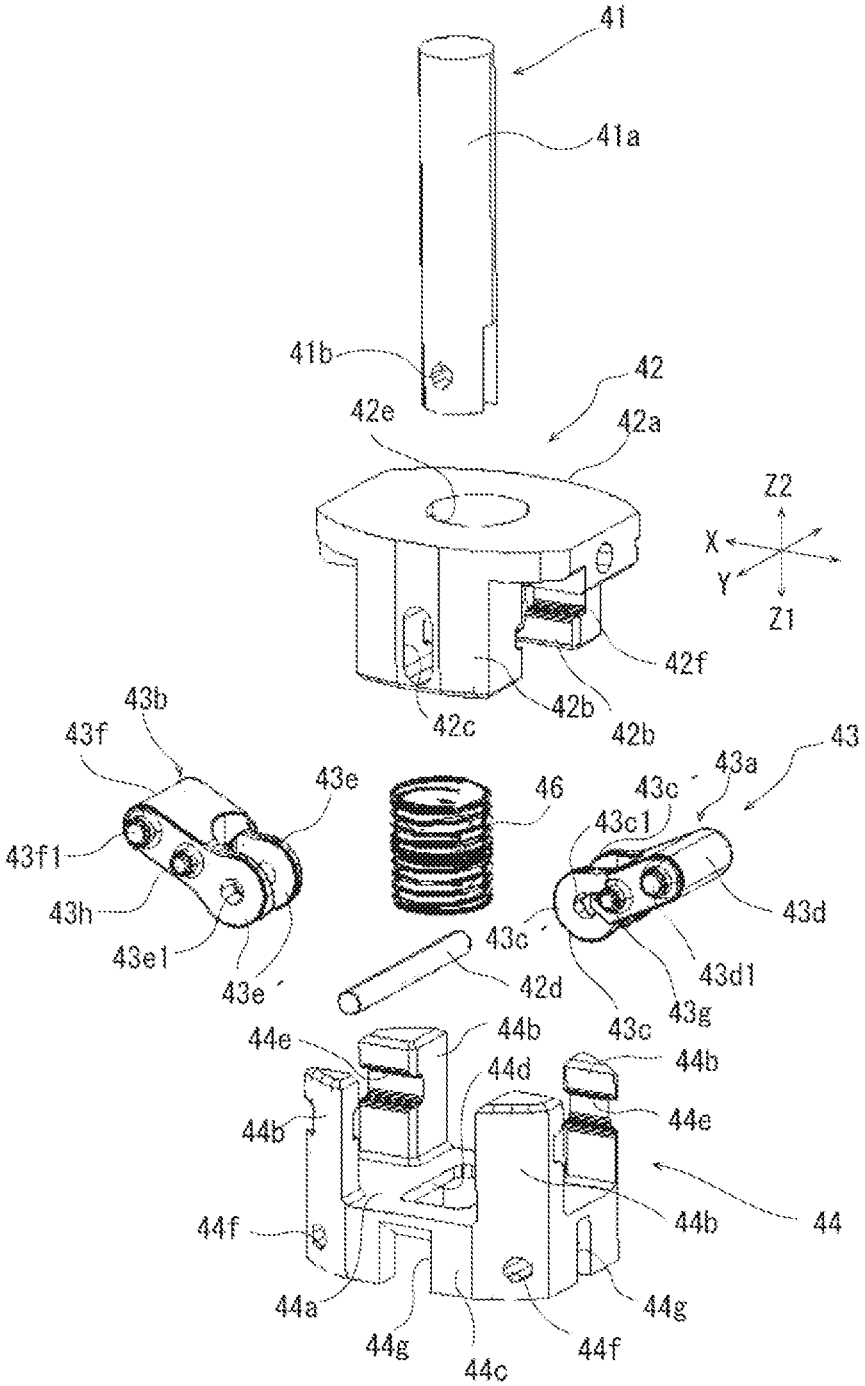
FIG. 6 is a decomposition stereogram illustrating a member constituting a same vibration unit.
Figure 7:
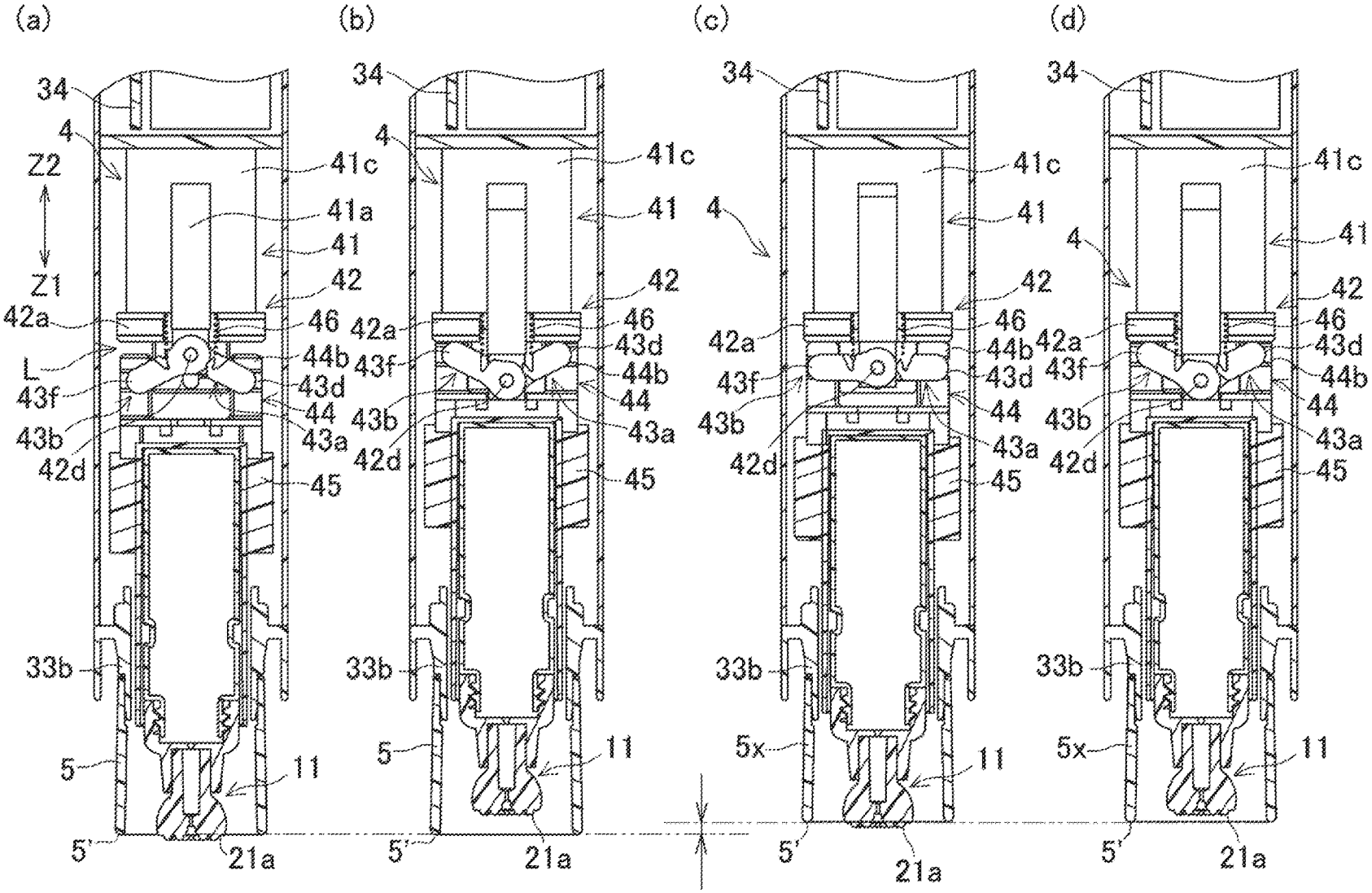
FIG. 7 is a longitudinal section view illustrating a vibration state of a same stain removal device.

FIG. 4 is a stereogram illustrating the vibration unit 4. FIG. 5(*a*) is a side view illustrating the vibration unit 4. FIG. 5 (*b*) is a front view illustrating constituent elements of the vibration unit 4. FIG. 6 is a decomposition stereogram illustrating the constituent elements of the vibration unit 4. FIG. 7 is a diagram for illustrating an action performed to vibrate the head portion 11. Hereinafter, the structure of the vibration unit 4 is described in detail with reference to FIG. 4 to FIG. 7.

As shown in FIG. 5(*b*), the vibration unit 4 has the solenoid actuator 41 described above, a coil spring 46, the link mechanism 40 and a piston 45.

As shown in FIG. 4 to FIG. 6, the link mechanism 40 includes a solenoid connecting portion 42, a link portion 43 and a piston fixing portion 44.

As shown in FIG. 6, the solenoid connecting portion 42 includes: a fixed side base portion 42*a* which is a plate-like member substantially parallel to the beating surface 21*a* shown in FIG. 2; protruding direction extended protruding portions 42*b* respectively extending from two end portions of the fixed side base portion 42*a* in the first direction Y to the protruding direction Z1; and a clamping pin 42*d* penetrating through a long hole 42*c* described later. A circular iron core through opening 42*e* penetrated by the movable iron core 41*a* embedded into the coil spring 46 is formed in a central portion of the fixed side base portion 42*a*. In addition, the long hole 42*c* penetrated by the clamping pin 42*d* and extending to the vibration direction is formed in a central portion in the second direction X of each protruding direction extended protruding portion 42*b*. A first annular groove 42*f* is formed in the inner surface of each protruding direction extended protruding portion 42*b* in the second direction X. Second clamping protrusions 43*g* and 43*h* of a first link member 43*a* and a second link portion 43*b* described later are movably clamped in the first annular grooves 42*f*.

As shown in FIG. 6, the link portion 43 includes the first link member 43*a* and a second link member 43*b*. The first link member 43*a* and the second link member 43*b* have a substantially same shape, and have a thickness exceeding the diameter of the movable iron core 41*a* in the first direction Y.

A pair of clamping pieces 43*c*' and 43*c*' separated from each other in the first direction Y is formed at an end portion 43*c* of the first link member 43*a* close to the second link member 43*b*. Pin through holes 43*c*1 penetrated by the clamping pin 42*d* are respectively formed in the pair of clamping pieces 43*c*' and 43*c*'. In addition, first clamping protrusions 43*d*1 reversely protruding to each other in the first direction Y are formed at another end portion 43*d* of the first link member 43*a*. Further, second clamping protrusions 43*g* parallel to the first clamping protrusions 43*d*1 and reversely protruding to each other are formed at the central portion in a long side direction of the first link member 43*a*.

A pair of clamping pieces 43*e*' and 43*e*' formed with the pin through holes 43*e*1 are also formed at an end portion 43*e* of the second link member 43*b* close to the first link member 43*a*. First clamping protrusions 43*f*1 reversely protruding to each other in the first direction Y are formed at another end portion 43*f* of the second link member 43*b*. In addition, second clamping protrusions 43*h* reversely protruding to each other are formed at the central portion in the long side direction of the second link member 43*b*.

A pin through hole 41*b* is formed in an end portion in the protruding direction Z1 of the movable iron core 41*a*. The movable iron core 41*a* is inserted into the solenoid connecting portion 42 via the iron core through hole 42*e*. The vicinity of the pin through hole 41*b* is clamped by the clamping pieces 43*c*' and 43*c*' of the first link portion and the clamping pieces 43*e*' and 43*e*' of the second link portion 43*b* from the second direction X. At this time, one of the clamping pieces 43*c*' and 43*c*' of the first link portion is inserted between the pair of clamping pieces 43*e*' and 43*e*' of the second link portion 43*b*; and the other of the clamping pieces 43*c*' and 43*c*' of the first link portion is inserted outside the pair of clamping pieces 43*e*' and 43*e*' of the second link portion 43*b*.

The clamping pin 42*d* penetrates the pin through holes 43*c*1 and 43*e*1 respectively formed in the clamping pieces 43*c*' and 43*c*' of the first link portion and the clamping pieces 43*e*' and 43*e*' of the second link portion 43*b*, as well as the pin through hole 41*b* of the movable iron core 41*a*, which are overlapped with each other. In addition, two end portions of the clamping pin 42*d* are inserted into the long hole 42*c* of the solenoid connecting portion 42 so as to be clamped with the long hole 42*c*.

When the coil spring 46 is wound on the movable iron core 41*a*, one end of the coil spring 46 is abutted against the clamping pin 42*d*, and the other end of the coil spring 46 is abutted against (or approaches) a solenoid body 41*c* shown in FIG. 5(*c*) and is accommodated between the clamping pieces 43*c*' and 43*c*' (43*e*' and 43*e*'). As a result, the movable iron core 41*a* is connected with the link members 43*a* and 43*b* by the clamping pin 42*d*.

The piston fixing portion 44 includes a movable side base portion 44*a* which is a plate-like member substantially parallel to the beating surface 21*a* shown in FIG. 2; returning direction extended protruding portions 44*b* respectively extending from four corners of the movable side base portion 44*a* to the returning direction Z2; and a piston covering portion 44*c* extending from four sides of the movable side base portion 44*a* to the protruding direction Z1. As shown in FIG. 6, when the movable iron core 41*a* is protruded to the protruding direction Z1, an opening 44*d* from which the clamping pieces 43*c*' and 43*c*' of the link portion 43 partially enters is formed in the central portion of the movable side base portion 44*a*. Second annular grooves 44*e* are formed in the inner surfaces of the returning direction extended protruding portions 44*b* in the second direction X. The first clamping protrusions 43*d*1 and 43*f*1 respectively formed on the first link member 43*a* and the second link member 43*b* are clamped with the second annular grooves 44*e* in a manner of freely moving in the grooves.

Notches 44*g* cut in the returning direction Z2 are formed in multiple positions of the piston covering portion 44*c*. As shown in FIG. 4, the piston covering portion 44*c* is clamped with a piston-fixed portion 45*c* extending from a bolt holding portion 45*a* of the piston 45 described later to the outer side of the circumferential direction through the notch 44*g*. In addition, fixed connecting holes 44*f* and 45*d* (referring to FIG. 5(*b*)) are formed in the piston covering portion 44*c* and the piston-fixed portion 45*c* in the first direction Y. The piston fixing portion 44 and the piston 45 are fixed to each other by inserting bolts and the like not shown in figures into the fixed connecting holes 44*f* and 45*d* in such a state that the end portions of the piston covering portion 44*c* and the bolt holding portion 45*a* on a returning direction Z2 side are embedded.

The piston 45 shown in FIG. 4 and FIG. 5 supports the liquid accommodating portion 12 in such a manner that the beating surface 21*a* (referring to FIG. 2) is located at the front end, can be moved to the vibration direction, and includes a bottle body holding portion 45*a* and the piston-fixed portion 45*c*.

The bottle body holding portion 45*a* is a component which is opened toward the head portion 11 and is of a bottomed substantially cylindrical shape. The clamping claw 45*b* capable of clamping the liquid accommodating portion 12 is arranged on the side surface of the bottle body holding portion 45*a*. The clamping claw 45*b* is configured to be elastically deformed toward the outer side of the bottle body holding portion 45*a* due to the pressing from the liquid accommodating portion 12 with the assembly and disassembly. Therefore, the liquid accommodating portion 12, on one hand, is clamped to the clamping claw 45*b* by the clamping concave portion 12*a* (referring to FIG. 3) in a manner of being inserted into the bottle body holding portion 45*a* and, on the other hand, can be pulled out of the bottle body holding portion 45*a* by being grasped by the inserted portion 25 or the vicinity thereof and is pulled to the protruding direction Z1 by a certain force.

Herein, as shown in FIG. 7, the solenoid actuator 41 is a non-through type solenoid actuator of which one end of the returning direction Z2 side is blocked, and is configured as a single-acting solenoid actuator which is stopped when the movable iron core 41*a* is moved to be abutted against the solenoid body 41*c* and pulls the movable iron core 41*a* up to the returning direction Z2 when a coil not shown in figures is energized. When the movable iron core 41*a* is subjected to the attraction force toward the returning direction Z2, the clamping pin 42*d* is moved to the returning direction Z2 along the long hole 42*c*. Moreover, one end portion 43*c* of the first link member 43*a* and one end portion 43*e* of the second link member 43*b* inserted into the clamping pin 42*d* are moved to the returning direction Z2. Therefore, the other end portion 43*d* of the first link member 43*a* and the other end portion 43*f* of the second link member 43*b* shown in FIG. 6 transfer a force toward the protruding direction Z1 to the second annular grooves 44*e* by the first clamping protrusions 43*d*1 and 43*f*1. As shown in FIG. 7(*a*), the piston fixing portion 44 and the piston 45 are integrally protruded to the protruding direction Z1. The head portion 11 is protruded to a position slightly protruding beyond a protruding end 5' of the protective cover 5. At this time, a gap L is formed in the vibration direction between the fixed side base portion 42*a* of the solenoid connecting portion 42 and the returning direction extended protruding portion 44*b* of the piston fixing portion 44. In addition, the coil spring 46 is pressed between the clamping pin 42*d* and the solenoid body 41*c* to accumulate an elastic force.

Then, when the energization to the solenoid actuator 41 is switched to OFF, a force toward the protruding direction Z1 is imparted to the clamping pin 42*d* by the elastic force of the coil spring 46. Thus, the first link member 43*a*, the second link member 43*b* and the movable iron core 41*a* inserted into the clamping pin 42*d* as shown in FIG. 6 are moved to the protruding direction Z1. The other end portion 43*d* of the first link member 43*a* and the other end portion 43*f* of the second link member 43*b* transfer the force toward the returning direction Z2 to the second annular grooves 44*e* by the first clamping protrusions 43*d*1 and 43*f*1. Thus, the coil spring 46 is used for releasing (returning) the movable iron core 41*a*; even if the stain removal device 100 is used in an inclination state for example, as shown in FIG. 7(*b*), the piston fixing portion 44 and the piston 45 are integrally and reliably moved to the returning direction Z2; and the head portion 11 is lifted to a specified size (about 5 mm in the present embodiment). Then, the fixed side base portion 42*a* of the solenoid connecting portion 42 and the returning direction extended protruding portion 44*b* of the piston fixing portion 44 are abutted against each other, or the movement toward the protruding direction Z1 of the movable iron core 41*a* is stopped.

The head portion 11 is vibrated (amplitude movement) by repeating such an action.

Herein, when the solenoid actuator 41 gives the movable iron core 41*a* a direction away from the head portion 11, i.e., the attraction force toward the returning direction Z2, the solenoid actuator 41 plays the strongest force when the movable iron core 41*a* is pulled up to the returning direction Z2. Therefore, the vibration unit 4 can protrude (push out) the head portion 11 when the movable iron core 41*a* is attracted to the returning direction Z2 by having the link mechanism 40 capable of protruding the head portion 11 to a direction opposite to the displacement direction of the movable iron core 41*a*, and can enhance the beating force.

In the present embodiment, a plurality of protective covers 5 and 5*x* having different vibration direction lengths (heights) mounted within the range of the operating stroke of the solenoid actuator 41 can be replaced at the front end portion 33*b* of the main body housing 33.

After the beating surface 21*a* of the head portion 11 is abutted against, for example, the clothes C placed on a table, even if in the range of the operating stoke of the solenoid actuator 41, the pull-up of the movable iron core 41*a* is mechanically stopped in the middle, so the operating stroke of the movable iron core 41*a* is shortened. Therefore, when the protective cover is replaced with a protective cover 5*x* having the vibration direction length, for example, about 2 mm, shorter than that of the protective cover 5, as shown in FIG. 7 (*c*), the movable iron core 41*a* is stopped in the middle before being pulled up to a position abutting against the solenoid body 41*c*, so the pulling size of the solenoid actuator 41 does not reach the maximum. Then, the movable iron core 41*a* is pushed out of the position described above, as shown in Fig. (d), to the protruding direction Z1 by the coil spring 46. Thus, the operating stroke of the solenoid actuator 41 is shortened. The beating force imparted to the clothes C by the head portion 11 becomes weaker (smaller) compared with the case that the protective cover 5 is used.

In this way, when the protective cover 5 is used for maximizing the pulling size of the solenoid actuator 41, the operating stroke is, for example, about 4 mm, and the beating force becomes strong. On the other hand, when the protective cover 5*x* is used and the pulling size does not reach the maximum, the operating stroke is, for example, 2 mm, and the beating force becomes weak.

With adoption of such a structure, a distance from the front end portion 33*b* of the main body housing 33 to the clothes C can be changed by replacing the protective covers 5 and 5*x* mounted on the main body housing 33, without electrically switching the solenoid actuator 41; and the operating stroke of the solenoid actuator 41 can be changed mechanically. When the operating stroke is electrically adjusted by such as a control base plate 34 and the like in order to adjust the beating force, the number of the components and the size of the device may be increased, but the device can be miniaturized by adopting a structure capable of replacing a plurality of protective covers 5 and 5*x* having different mounting lengths; and the strength of the beating force applied to the clothes C by the head portion 11 can be adjusted.

In the present embodiment, further, when an operation button (a switching portion) 33*d* (referring to FIG. 1) is operated, an action frequency of the solenoid actuator 41 is changed by the control base plate 34 (referring to FIG. 2) configured at a position adjacent to the battery 32; and the vibration speed (beating speed) of the head portion 11 can be changed. Thus, the strength and speed of the beating force can be adjusted correspondingly to the type of the clothes C. For example, multiple washing modes, such as gentle washing with a weak beating force and a low speed, strong washing with a strong beating force and a high speed and the like can be realized.

Although one embodiment of the present disclosure is described above, specific structures of various parts are not limited to the embodiments described above.

For example, although the present embodiment adopts a structure (exchange type) that the plurality of protective covers 5 having different vibration direction lengths can be mounted on the main body housing 33, the present disclosure is not limited to such a structure and can also adopt a structure that the changing portions capable of changing the length of the protective cover protruding from the front end portion of the main body housing within the range of the operating stroke of the solenoid actuator 41 are formed on the main body housing and the protective cover.

Figure 8:
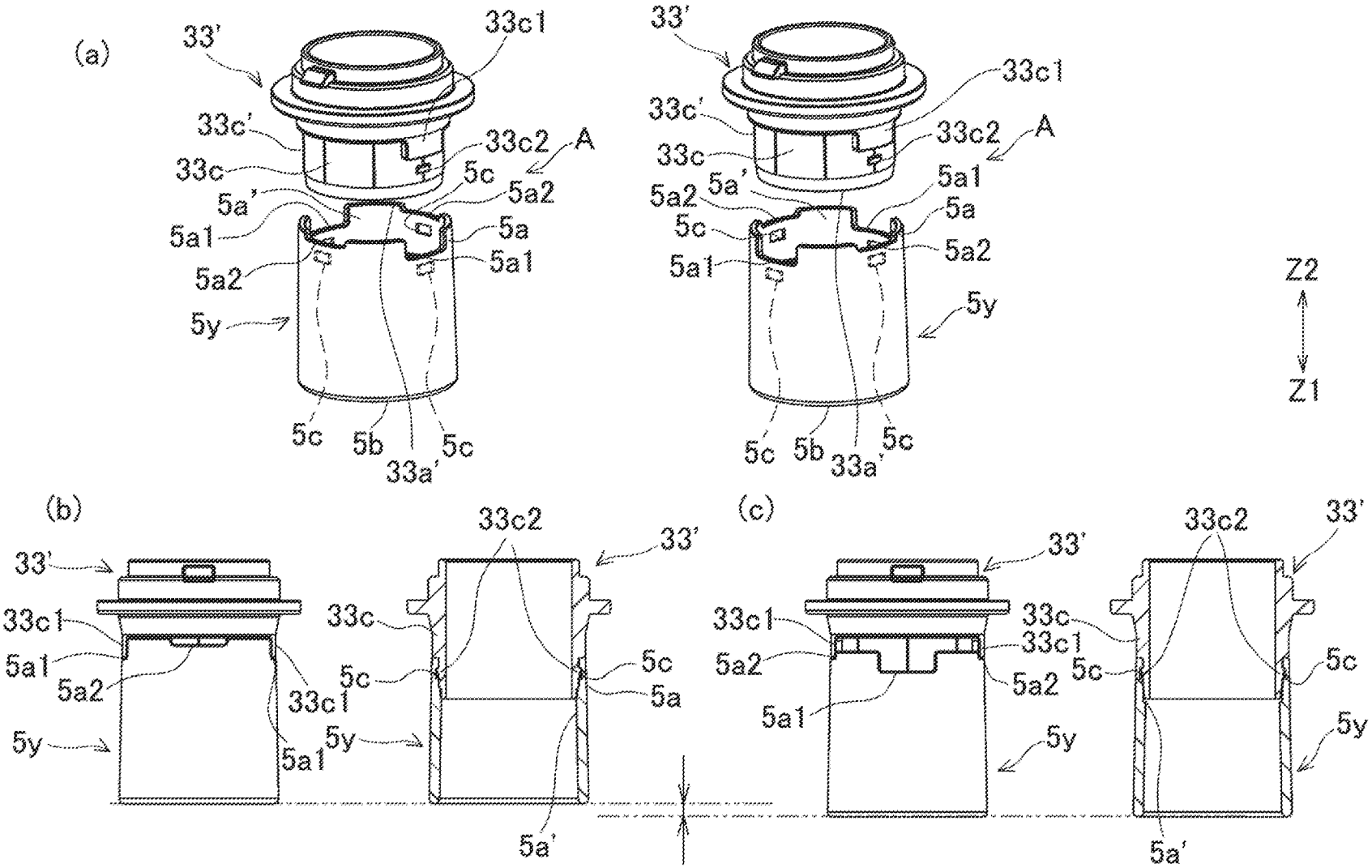
FIG. 8 is a diagram illustrating a variation example of the present disclosure.

As a specific structure that the changing portions are formed, a mounting direction-specified protective cover 5*y* shown in FIG. 8 is described. FIG. 8 (*a*) is a stereogram illustrating a main body housing 33' and the protective cover 5*y* in a decomposed state. FIGS. 8 (*b*) and (*c*) are a front view and a longitudinal section view illustrating a state that the protective cover 5*y* is mounted on the main body housing 33'.

As shown in FIG. 8 (*a*), a part of the protective cover 5*y* passing through the basal end portion 5*a* is cut into a substantially rectangular shape, so as to form a plurality of concave portions 5*a*1 and 5*a*2 having different depths at four equidistant positions in a circumferential direction of the basal end portion 5*a*. The concave portions 5*a*1 and 5*a*2 are formed in such a manner that relatively deep first concave portions 5*a*1 are formed at two positions corresponding to each other, and relatively shallow second concave portions 5*a*2 are formed at two positions opposite to each other. In addition, an inner circumferential surface 5*a*' is recessed to form the buckling portion 5*c* buckled by a claw portion 33*c*2 described later at a position of the basal end portion 5*a* at a specified distance deviating from the first concave portion 5*a*1 and the second concave portion 5*a*2 to a protruding end 5*b* side.

A convex portion 33*c*1 corresponding to the first concave portion 5*a*1 in shape is formed in the front end portion 33*c* of the main body housing 33'. In addition, an elastically deformable claw portion 33*c*2 is formed on a side closer to an opening end 33*a*' than the convex portion 33*c*1 on an outer circumferential surface 33*c*' of the front end portion 33*c*.

The first concave portion 5a1, the second concave portion 5a2 and the claw portion 33c2 constitute a changing portion A capable of changing the length of the protective cover 5y protruding from the front end portion 33c of the main body housing 33'. As shown in FIG. 8(*b*), when the protective cover 5y is embedded in the main body housing 33' in such a manner that the first concave portion 5a1 is clamped with the convex portion 33c1, the claw portion 33c2 is clamped with the buckling portion 5c. At this time, the first concave portion 5a1 and the convex portion 33c1 are clamped with each other without gap; and the main body housing 33' is closely adhered to the protective cover 5y in the vibration direction.

On the other hand, when the protective cover 5y is temporarily pulled to the protruding direction Z1 to release the clamping of the first concave portion 5a1 and the convex portion 33c1, the protective cover 5y is brought close to the main body housing 33' again by rotating the protective cover 5y to the circumferential direction by 90° relative to the main body housing 33'; and the second concave portion 5a2 can be embedded with the convex portion 33c1. In this case, as shown in Fig. (c), since only a part (front end portion) of the convex portion 33c1 is clamped with the second concave portion 5a2, the protective cover 5y is not inserted into the main body housing 33' deeply, the protruding length of the protective cover 5y is increased to the corresponding length. In this case, the claw portion 33c2 is clamped with the buckling portion 5c, so the protective cover 5y and the main body housing 33' are fixed to each other.

In this way, the convex portion 33c1, as the changing portion A, extending to the axis direction of the head portion 11 is formed at the front end portion 33c of the main body housing 33'. The first concave portion 5a1 having the depth for substantially clamping the entire convex portion 33c1 and the second concave portion 5a2 shallower than the first concave portion 5a1 are formed as the changing portions at the basal end portion 5a of the protective cover 5y as the cover portion. When the convex portion 33c1 is clamped with the first concave portion 5a1 and the second concave portion 5a2, the protruding length of the protective cover 5y can be changed.

Thus, when the protective cover 5y is mounted on the main body housing 33', the length of the protective cover 5y protruding from the front end portion 33c of the main body housing 33' can be changed by clamping the relatively deeper first concave portion 5a1 with the convex portion 33c1 or clamping the relatively shallow second concave portion 5a2 with the convex portion 33c1; the operating stroke (attraction stroke) of the solenoid actuator 41 can be changed mechanically; and the strength of the beating force can be easily adjusted by one protective cover 5y.

In addition, an elastically deformable claw portion 33c2 is formed at the front end portion 33c of the main body housing 33'. The buckling portion 5c buckled with the claw portion 33c2 is formed at a position, at which the convex portion 33c1 is clamped with the first concave portion 5a1 or the second concave portion 5a2, of the basal end portion 5a of the protective 5y.

Thus, the claw portion 33c2 can be clamped with the clamping portion 5c, and the protective cover 5y is fixedly mounted on the main body housing 33', so as to prevent the protective cover 5y from being separated from the main body housing 33' during the stain removing operation.

It should be noted that a structure that the first concave portion 5a1, the second concave portion 5a2 and the buckling portion 5c are formed at the front end portion 33c of the main body housing 33', and the convex portion 33c1 and the claw portion 33c2 are formed at the basal end portion 5a of the protective cover 5y can also be adopted.

Further, a structure that a screw portion is formed on the outer circumferential surface of any of the main body housing and the protective cover portion as the changing portion, a nut portion corresponding to the screw portion is formed on an inner circumferential surface of any of the main body housing and the protective cover as the changing portion, and the protruding length of the protective cover can be changed by increasing or decreasing a screw-in quantity of the screw portion screwed into the nut portion can also be adopted.

With adoption of such a structure, since the main body housing and the protective cover can be mounted by screwing one into the other, the length of the protective cover protruding from the front end portion of the main body housing can be changed continuously, and the strength of the beating force can be easily adjusted by one protective cover.

Further, a structure that other cover portions can also be complementally mounted at the front end portion of the protective cover to adjust the protruding length of the protective cover can also be adopted.

In addition, although the stain removal device 100 of the above embodiment is a device which uses the beating surface 21a of the head portion 11 downward, the stain removal device 100 can also be configured to use the beating force 21a toward a transverse direction. In this case, the movable iron core 41a can also be stably pushed out to the protruding direction Z1 by the coil spring 46.

Further, in the above-described embodiment, the operating stroke of the solenoid actuator 41 is adjusted by the protective covers 5, 5x, 5y and the like, but not limited to such a mechanical structure; and the operating stroke of the solenoid actuator 41 can also be adjusted by electrical control. In addition, the link mechanism 40 may not be provided, and the head portion 11 is protruded when the movable iron core 41a is attracted.

In addition, in the above-described embodiment, the detergent mixture may be used as the liquid. In this case, since the detergent is continuously supplied to the stain portion sp of the clothes C during the stain removing operation, the detergent does not disappear from the stain portion sp due to gasification, scattering and the like, thereby maintaining the high stain removing effect.

In addition, materials of the members of the stain removal device 100 are not limited to the materials shown by dash lines in each drawing.

Other structures can also be subjected to various variations without departing from a scope of technical spirits of the present disclosure.

What is claimed is:

1. A stain removal device, comprising:

a head portion, formed with a beating surface;

a vibration unit, which is located on an extension line of an axis of the head portion orthogonal to the beating surface and vibrates the head portion in an axis direction through driving of a solenoid actuator;

a liquid supply unit, which has a liquid accommodating portion capable of accommodating liquid and supplies the liquid in the liquid accommodating portion to the beating surface through vibration of the head portion generated by the vibration unit;

a main body housing, wherein the head portion protrudes from a front end portion of the main body housing; and a cover portion, detachably arranged at the front end portion of the main body housing, wherein a changing portion is formed on the main body housing and the cover portion, and is operative to change a length of the cover portion protruding from the front end portion of the main body housing within a range of an operating stroke of the solenoid actuator;

wherein the changing portion comprises: a convex portion extending to the axis direction that is formed at one of the front end portion of the main body housing and a basal end portion of the cover portion; a first concave portion that has a depth configured for substantially clamping the entire convex portion and a second concave portion that is shallower than the first concave portion, the first concave portion and the second concave portion being formed at the other of the front end portion of the main body housing and the basal end portion of the cover portion; wherein the convex portion is operative to be clamped with the first concave portion or the second concave portion so as to change a protruding length of the cover portion.

2. The stain removal device according to claim 1, comprising:

a main body housing, wherein the head portion protrudes from a front end portion of the main body housing; and a plurality of cover portions, which are detachably arranged at the front end portion of the main body housing and have different lengths in the axis direction within a range of an operating stroke of the solenoid actuator, wherein the stain removal device is used in such a state that any of the plurality of cover portions is mounted at the front end portion of the main body housing.

3. The stain removal device according to claim 2, wherein the solenoid actuator imparts an attraction force away from a direction of the head portion to a movable iron core; and the vibration unit has a link mechanism which is operative to cause the head portion to protrude in a direction opposite to a displacement direction of the movable iron core.

4. The stain removal device according to claim 1, wherein an elastically deformable claw portion is formed at one of the front end portion of the main body housing and the basal end portion of the cover portion; and a buckling portion buckled with the claw portion is formed at a position, at which the convex portion is clamped with the concave portion, of the other of the front end portion of the main body housing and the basal end portion of the cover portion.

5. The stain removal device according to claim 4, wherein the solenoid actuator imparts an attraction force away from a direction of the head portion to a movable iron core; and the vibration unit has a link mechanism which is operative to cause the head portion to protrude in a direction opposite to a displacement direction of the movable iron core.

6. The stain removal device according to claim 1, wherein the solenoid actuator imparts an attraction force away from a direction of the head portion to a movable iron core; and the vibration unit has a link mechanism which is operative to cause the head portion to protrude in a direction opposite to a displacement direction of the movable iron core.

7. A stain removal device, comprising:

a head portion, formed with a beating surface;

a vibration unit, which is located on an extension line of an axis of the head portion orthogonal to the beating surface and vibrates the head portion in an axis direction through driving of a solenoid actuator;

a liquid supply unit, which has a liquid accommodating portion capable of accommodating liquid and supplies the liquid in the liquid accommodating portion to the beating surface through vibration of the head portion generated by the vibration unit;

a main body housing, wherein the head portion protrudes from a front end portion of the main body housing; and a cover portion, detachably arranged at the front end portion of the main body housing, wherein a changing portion is formed on the main body housing and the cover portion, and is operative to change a length of the cover portion protruding from the front end portion of the main body housing within a range of an operating stroke of the solenoid actuator;

wherein the changing portion comprises: a screw portion formed on an outer circumferential surface of one of the main body housing and the cover portion; and a nut portion corresponding to the screw portion that is formed on an inner circumferential surface of the other of the main body housing and the cover portion; wherein the protruding length of the cover portion is operative to be changed by increasing or decreasing a screw-in quantity of the screw portion screwed into the nut portion.

8. The stain removal device according to claim 7, wherein the solenoid actuator imparts an attraction force away from a direction of the head portion to a movable iron core; and the vibration unit has a link mechanism which is operative to cause the head portion to protrude in a direction opposite to a displacement direction of the movable iron core.

* * * * *